United States Patent [19]

Shibuya

[11] 4,299,543

[45] Nov. 10, 1981

[54] SWASH PLATE COMPRESSOR

[75] Inventor: Tsunenori Shibuya, Konan, Japan

[73] Assignee: Diesel Kiki Company, Ltd., Tokyo, Japan

[21] Appl. No.: 5,715

[22] Filed: Jan. 23, 1979

[30] Foreign Application Priority Data

Jan. 31, 1978 [JP] Japan ..... 53-10888[U]

[51] Int. Cl.[3] ..... F04B 1/16

[52] U.S. Cl. ..... 417/269

[58] Field of Search ..... 417/269

[56] References Cited

U.S. PATENT DOCUMENTS

| | | | |
|---|---|---|---|
| 3,749,523 | 7/1973 | Wahl | 417/269 |
| 3,785,751 | 1/1974 | Nemoto | 417/269 |
| 3,801,227 | 4/1974 | Nakayama | 417/269 |
| 3,904,320 | 9/1975 | Kishi | 417/269 |
| 3,955,899 | 5/1976 | Nakayama | 417/269 |
| 3,981,629 | 9/1976 | Nakayama | 417/269 |
| 3,999,893 | 12/1976 | Kisho | 417/269 |
| 4,003,680 | 1/1977 | Nakayama | 417/269 |
| 4,070,136 | 1/1978 | Nakayama | 417/269 |
| 4,127,363 | 11/1978 | Kato et al. | 417/269 |

FOREIGN PATENT DOCUMENTS

| | | | |
|---|---|---|---|
| 2151128 | 5/1972 | Fed. Rep. of Germany | 417/269 |
| 52-94300 | 10/1977 | Japan | 417/269 |

*Primary Examiner*—William L. Freeh

*Attorney, Agent, or Firm*—David G. Alexander

[57] ABSTRACT

A circular cylinder (12) is formed with a plurality of bores (18), (19), (21), (23) in which double acting pistons (33) are slidably disposed. A diagonally oriented swash plate (24) reciprocates the pistons (33) for compressively displacing fluid through the bores (18), (19), (21), (23). A lower portion of the cylinder (12) defines a lubricant sump or chamber (81) in which a lubricant oil is contained. The swash plate (24) is partially immersed in the oil for spash lubrication.

Cylinder heads (63), (73) are fixed to the opposite ends of the cylinder (12) and are each formed with an inlet chamber (68), (76) and an outlet chamber (71), (77). Partitions (121), (126) formed in the cylinder (12) sealingly define secondary chambers (122), (127) in the lubricant chamber (81) which may communicate with either the inlet chambers (68), (76) or the outlet chambers (71), (77) to constitute extensions thereof.

1 Claim, 6 Drawing Figures

SWASH PLATE COMPRESSOR

CROSS REFERENCE TO RELATED APPLICATION

The present invention constitutes a novel and unique improvement to copending U.S. Patent Application Ser. No. 949,000, filed Oct. 5, 1978, entitled "SWASH PLATE COMPRESSOR", which is assigned to the same assignee as this application.

BACKGROUND OF THE INVENTION

The present invention relates to an improved swash plate compressor. This type of compressor generally includes a cylinder which is formed with a plurality of axial bores. Double acting pistons are slidably disposed in the bores. A swash plate diagonally mounted on a shaft is connected to the pistons in such a manner that rotation of the shaft and swash plate causes reciprocation of the pistons to compressively displace a fluid. Swash plate compressors are often used as refrigerant compressors for automotive air conditioning systems and the like.

In order to lubricate the swash plate, pistons etc. a lubricant chamber or sump is generally provided in the lower portion of the cylinder containing oil in which the swash plate is partially immersed. The swash plate spashes the oil onto the internal components of the compressor to provide lubrication.

However, since a substantial amount of oil must be splashed about for effective lubrication, a problem has existed in providing a lubricant chamber of sufficient volume to contain the required amount of oil.

One expedient has been to provide a large volume lubricant chamber extending downwardly from the body of the cylinder. Whereas this increases the volume of the lubricant chamber to the required size, the protruding lubricant chamber increases the overall size of the compressor and makes mounting difficult.

In consideration of efficient manufacturing and other considerations, it is desirable for the cylinder to a have circular cross section. Although swash plate compressors having lubricant chambers completely contained in the lower portions of circular cylindrical bodies have been manufactured and used, the lubricant oil volume is only marginally sufficient and failure of such compressors under maximum load conditions has occured due to lack of lubrication. The problem is especially critical during start-up of the compressor.

This problem is overcome in the above identified copending patent application by providing cylinder heads at the ends of the cylinder which are formed with chambers which communicate with and constitute extensions of the lubricant chamber in the cylinder.

However, another problem has remained unsolved in the present type of compressor which is caused by the basic operation of the compressor itself. Due to the fact that the pistons are reciprocated in the respective bores, the inlet and outlet pressures of the compressor fluctuate in a pulsating manner. This leads to excessive mechanical stress and generally degraded operation of the other components of the refrigeration system which are connected to the compressor as well as the compressor itself.

SUMMARY OF THE INVENTION

In accordance with the present invention a swash plate compressor includes a circular cylinder formed with at least one axial bore, at least one piston slidably disposed in the at least one bore respectively and a swash plate supported within the cylinder for reciprocating the at least one piston upon rotation of the swash plate. A lubricant chamber is formed in a lower portion of the cylinder and axially extends through an end of the cylinder. A cylinder head is attached to said end of the cylinder and formed with a lubricant chamber in a lower portion thereof which communicates with and constitutes an extension of the lubricant chamber of the cylinder.

In order for the compressor to operate effectively, the portion of the swash plate which is immersed in the lubricant oil in the lubricant chamber must not exceed one-half the radius of the swash plate. If the oil level is increased beyond this point the viscous frictional drag on the swash plate will increase greatly and the power required to rotate the swash plate will become excessive. In addition, such an arrangement will result in excessive oil consumption.

Due to this fact, the upper portion of the lubricant chamber is not filled with lubricant and constitutes wasted space in the prior compressor.

The present invention overcomes the problem of excessive pulsations in the inlet and outlet pressures of the compressor by utilizing the heretofore wasted upper space in the lubricant chamber in an effective manner. More specifically, one or more partitions are formed in the lubricant chamber to define separate secondary chambers which do not communicate with the remainder of the lubricant chamber. Instead, these secondary chambers are communicated with inlet or outlet chambers formed in the cylinder heads and constitute extensions thereof. The generally increased effective volume of the inlet and outlet chambers and the positions of the secondary chambers reduce the inlet and outlet pressure pulsations by a major extent.

It is an object of the present invention to provide an improved swash plate compressor which utilizes heretofore wasted space in an effective manner.

It is another object of the present invention to provide an improved swash plate compressor comprising novel and unique means for reducing pulsations in inlet and outlet pressures.

It is another object of the present invention to provide a swash plate compressor comprising inlet and outlet chambers of increased size and improved shape.

It is another object of the present invention to provide an improved swash plate compressor which is more compact and easier and less costly to manufacture on a commercial production basis than swash plate compressors known heretofore.

It is another object of the present invention to provide a generally improved swash plate compressor.

Other objects, together with the foregoing, are attained in the embodiment described in the following description and illustrated in the accompanying drawing.

DESCRIPTION OF THE PREFERRED EMBODIMENT

While the swash plate compressor of the present invention is susceptible of numerous physical embodiments, depending upon the environment and requirements of use, substantial numbers of the herein shown and described embodiment have been made, tested and used, and all have performed in an eminently satisfactory manner.

Figure 1:
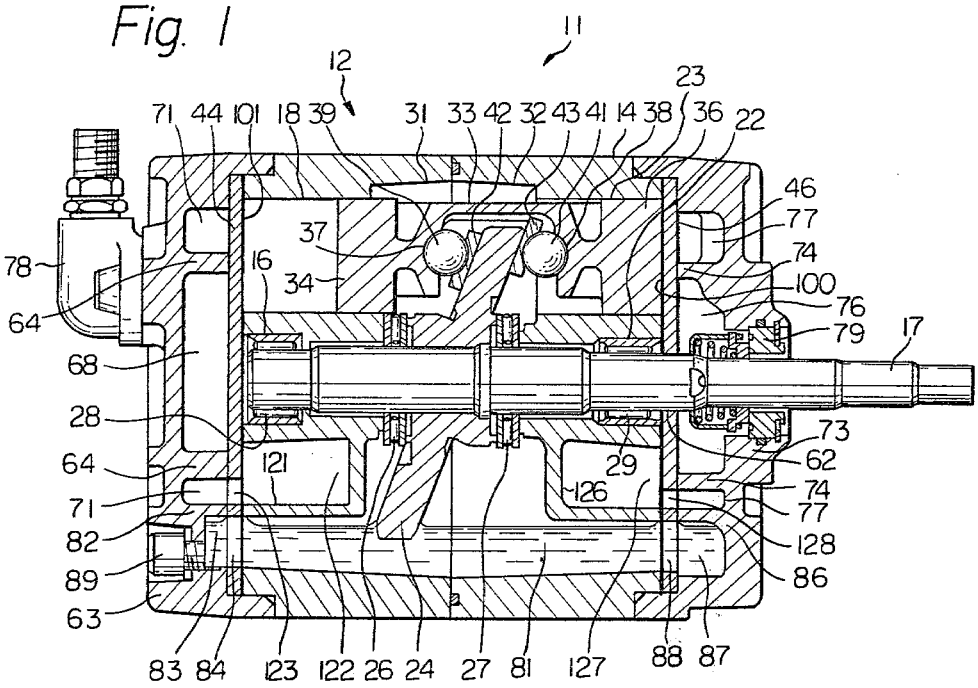
FIG. 1 is a longitudinal sectional view of a swash plate compressor embodying the present invention.
Figure 2:
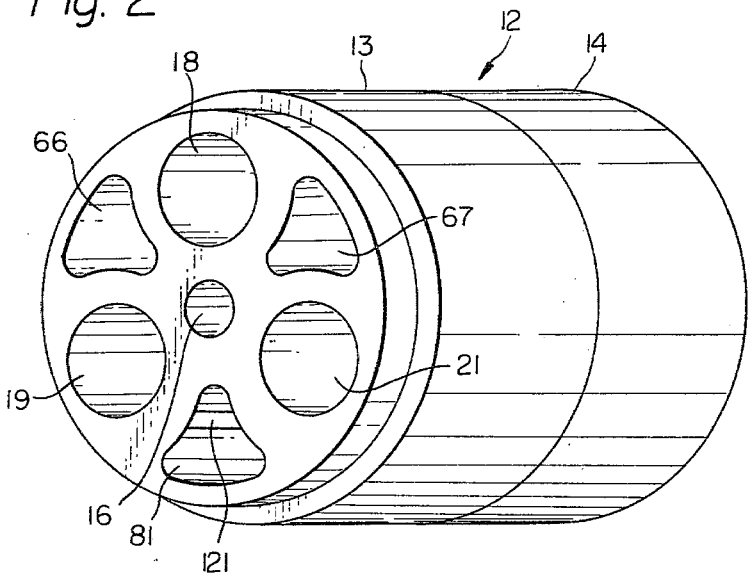
FIG. 2 is a perspective view of a cylinder of the compressor.

Referring now to FIG. 1 of the drawing, a swash plate compressor embodying the present invention is generally designated by the reference numeral 11 and comprises a circular cylinder 12. The cylinder 12 is formed in two halves which are designated as 13 and 14. With reference also being made to FIG. 2, the cylinder half 13 is formed with a central circular bore 16 for a drive shaft 17 and three circumferentially spaced circular bores 18, 19 and 21 which extend completely through the cylinder half 13.

The cylinder half 14 is formed with a central bore 22 for the drive shaft 17 and three bores identical to the bores 18, 19 and 21, although only one of these bores is visible in the drawing and designated as 23.

A diagonal swash plate 24 is fixed on the drive shaft 17 for integral rotation. The drive shaft 17 and swash plate 24 are rotatably supported in the cylinder 12 by means of thrust bearings 26 and 27 and radial bearings 28 and 29. The axially inner portions of the cylinder halves 13 and 14 are cut away as indicated at 31 and 32 to allow the swash plate 24 to pass between the openings of the bores 18, 19, 21, and the bore 23 and two non-illustrated bores of the cylinder halves 13 and 14.

A double acting piston 33 is slidably disposed in the bores 18 and 23. The piston 33 is formed with two heads, designated as 34 and 36, which are joined together. The heads 34 and 36 are formed with pockets 37 and 38 for balls 39 and 41 respectively. Shoes 42 and 43 are slidably disposed between the left and right faces of the swash plate 24 and the balls 39 and 41 respectively. Essentially similar pistons are provided in the other two sets of bores, although not illustrated.

Figure 3:
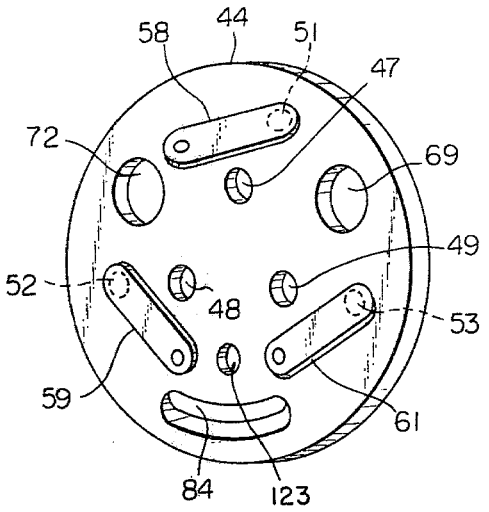
FIG. 3 is a perspective view of a valve plate of the compressor.
Figure 5:
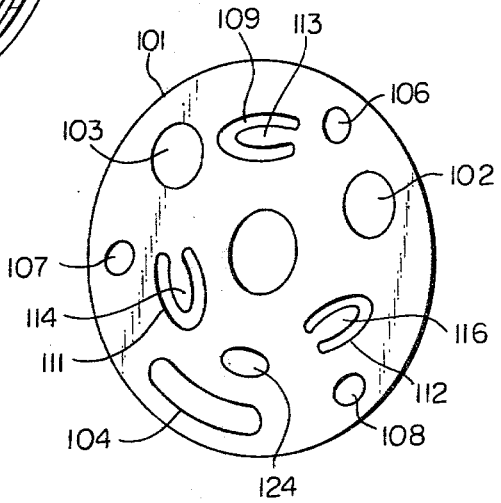
FIG. 5 is a perspective view of an inlet valve plate of the compressor.

Attached to the left and right ends of the cylinder 12 are valve plates 44 and 46 respectively. The valve plate 44 is shown in FIG. 3 as being formed with radially inner inlet ports 47, 48 and 49 and radially outer outlet ports 51, 52 and 53 which open into the bores 18, 19 and 21 respectively. An inlet valve plate 101 shown in FIG. 5 is attached to the valve plate 44 and allows fluid flow through the inlet ports 47, 48 and 49 only into the bores 18, 19 and 21 respectively. Outlet flapper valves 58, 59 and 61 are also mounted on the valve plate 44 and allow fluid flow through the outlet ports 51, 52 and 53 only out of the bores 18, 19 and 21 respectively. The valve plate 46 is formed with an essentially similar valve arrangement including an inlet valve plate 100, although not shown in detail. The valve plate 46 is further formed with an opening 62 for the drive shaft 17.

Figure 4:
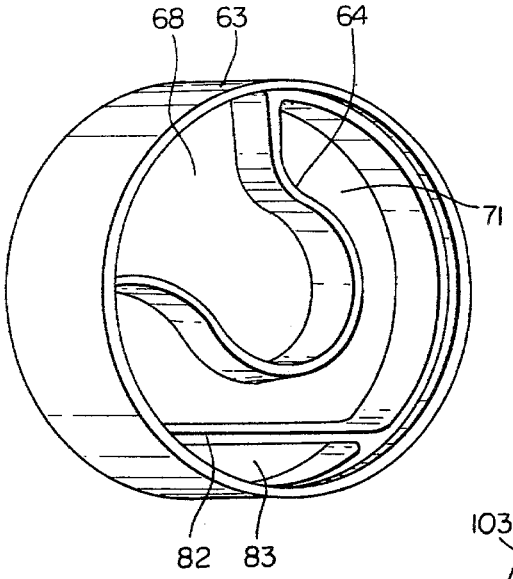
FIG. 4 is a perspective view of a cylinder head of the compressor.

The compressor 11 further comprises a left cylinder head 63 which is shown in FIG. 4. The cylinder head 63 is basically a cap which is attached to and seals the left end of the cylinder 12. However, the cylinder head 63 is formed with a curved partition 64.

As shown in FIG. 2 the cylinder 12 is formed with axial passageways 66 and 67 which extend completely through both cylinder halves 13 and 14. The partition 64 is formed as shown to define an inner inlet chamber 68 which communicates with the bores 18, 19 and 21 through the inlet ports 47, 48 and 49 and also with the passageway 67 through a hole 69 formed through the valve plate 44. The partition 64 also defines an outer outlet chamber 71 which communicates with the bores 18, 19 and 21 through the outlet ports 51, 52 and 53 and also with the passageway 66 through a hole 72 formed through the valve plate 44.

The compressor 11 further comprises a right cylinder head 73 formed with a partition 74 identical to the partition 64. The partition 77 defines an inlet chamber 76 and an outlet chamber 77 which communicate with the bores of the cylinder half 14 through the valves of the valve plate 46. In addition, the inlet and outlet chambers 76 and 77 communicate with the inlet and outlet chambers 68 and 71 through holes (not shown) formed through the valve plate 46 and the passageways 67 and 66 respectively. The inlet chamber 68 is connected to an evaporator of an air conditioning system (not shown) or the like through an inlet connector 78. The outlet chamber 71 is connected to an expansion valve of the air conditioning system through a condensor (not shown). Further illustrated is a seal 79 for the shaft 17.

In operation, the shaft 17 is rotated. Since the swash plate 24 is rigidly mounted on the shaft 17 it also rotates. This causes the piston 33 and the other two non-illustrated pistons to reciprocate once per revolution of the swash plate 24.

As the swash plate 24 approaches the position illustrated in FIG. 1, the piston head 36 displaces refrigerant fluid out of the bore 23 whereas the piston head 34 sucks refrigerant fluid into the bore 18. The inlet valve plate 101 allows fluid flow into the bore 18 whereas the corresponding non-illustrated valve provided to the valve plate 46 allows fluid flow out of the bore 23. As the swash plate 24 is rotated 180° the piston 33 is moved leftwardly so that the piston head 34 displaces fluid out of the bore 18 whereas the piston head 36 sucks fluid into the bore 23. This action causes fluid to be compressively displaced from the inlet chambers 68 and 76 through the bores into the outlet chambers 71 and 77 and thereby through the compressor 11.

The cylinder 12 is also formed with a lubricant chamber 81 which extends completely through the lower portions of the cylinder halves 13 and 14. The chamber 81 is circumferentially spaced between the lowermost two bores 19 and 21. The cylinder 12 is cut away at the upper wall of the chamber 81 to allow the swash plate 24 to be partially immersed in lubricant oil or the like contained in the chamber 81. The swash plate 24, upon rotation thereof, picks up and splashes oil all around the interior of the cylinder 12 to lubricate the pistons, etc. which constitute the moving parts of the compressor 11.

The cylinder head 63 is formed with another partition 82 which separates the outlet chamber 71 from a lubricant chamber 83 defined in the lower portion of the cylinder head 63 aligned with the chamber 81. The vlave plate 44 is formed with a passageway 84 therethrough which communicates the chamber 83 with the chamber 81.

In an essentially similar manner, the cylinder head 73 is formed with another partition 86 which separates the outlet chamber 77 from a lubricant chamber 87 defined in the cylinder head 73. The chamber 87 communicates with the chamber 81 through a passageway 88 formed through the valve plate 46. The chambers 83 and 87 constitute extensions of the chamber 81.

Further illustrated is a drain plug 89 provided to the chamber 83 to allow oil to be drained from the chambers 81, 83 and 87.

As shown in FIG. 5, the flapper valve plate 101 is provided at the valve plate 44 rightwardly thereof and is formed with holes 102, 103 and 104 conjugate to the holes 69 and 72 and passageway 84 respectively. The plate 101 is further formed with holes 106, 107 and 108 conjugate to the outlet ports 51, 52 and 53 respectively.

U-shaped holes 109, 111 and 112 are formed through the plate 101 to defined inlet flapper valves 113, 114 and 116 which normally cover the inlet ports 47, 48 and 49 respectively.

The plate 101 is formed of a resilient material such as spring steel or the like. Thus, the inlet flapper valves 113, 114 and 116 are deformable by inlet suction to uncover the inlet ports 47, 48 and 49.

In accordance with an important feature of the present invention, the cylinder half 13 is formed with a partition 121 which sealingly defines a secondary outlet chamber 122 occupying space in the upper portion of the lubricant chamber 81. The partition 121 seals the chamber 122 from the chamber 81. The valve plate 44 is further formed with a hole 123 which communicates the secondary outlet chamber 122 with the outlet chamber 71. Where the valve plate 101 is used, it is formed with a hole 124 which serves the same function as the hole 123.

In an essentially similar manner, the cylinder half 14 is formed with a partittion 126 which defines another secondary outlet chamber 127 in the lubricant chamber 81. The valve plate 46 is formed with a hole 128 which communicates the secondary outlet chamber 127 with the outlet chamber 77. It will thus be seen that outlet fluid is contained in the compressor 11 within a closed passageway which comprises the outlet chambers 71 and 77 which are connected by the passageway 66 and also the secondary outlet chambers 122 and 127 which communicate with the outlet chambers 71 and 77 through the holes 123 and 128 respectively.

The secondary outlet chambers 122 and 127 occupy heretofore unused space in the lubricant chamber 81 although they do not communicate with the lubricant chamber 81. The chambers 122 and 127 not only increase the overall volume of the outlet passageway, but also due to their positions function to reduce outlet pressure pulsations by acting as mufflers or dampers.

Figure 6:
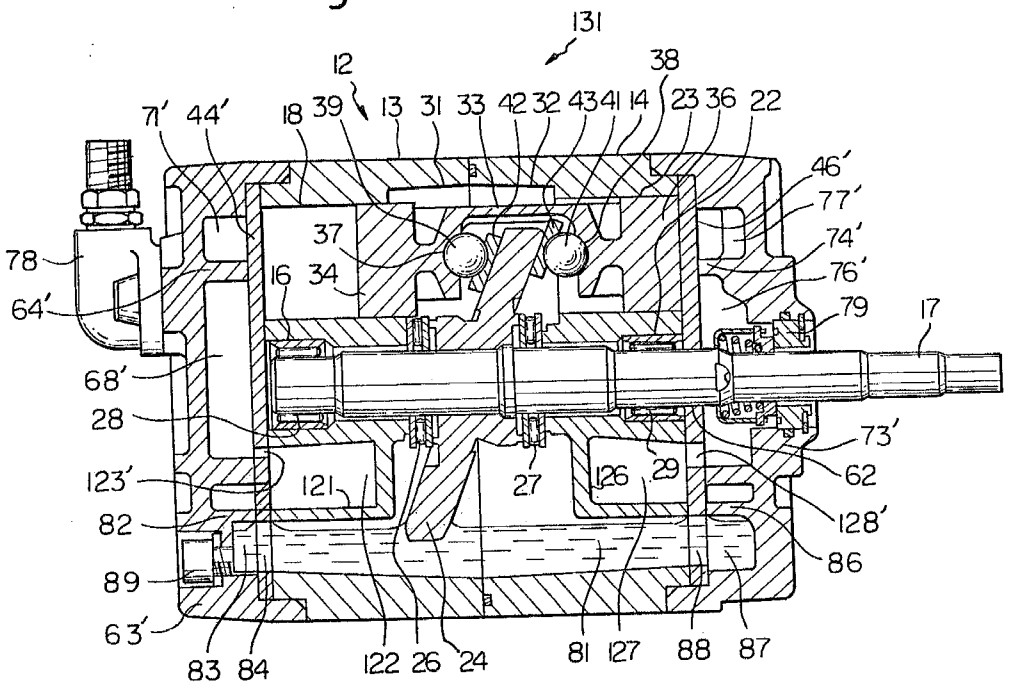
FIG. 6 is a longitudinal sectional view of another embodiment of the present swash plate compressor.

FIG. 6 illustrates another swash plate compressor 131 embodying the present invention in which like elements are designated by the same reference numerals and corresponding but modified elements are designated by the same reference numerals primed.

The difference between the compressor 131 and the compressor 11 is in the configuration of the cylinder heads 63' and 73'. More specifically, the partitions 64' and 74' are formed in such a manner that the holes 123' and 128' and thereby the chambers 122 and 127 communicate with the inlet chambers 68' and 76' rather than with the outlet chambers 71' and 77'. With this construction, the chambers 122 and 127 serve as secondary inlet chambers rather than secondary outlet chambers.

In summary, it will be seen that the present invention provides an improved swash plate compressor which uses heretofore wasted space to define secondary inlet or outlet chambers which increase the overall inlet or outlet chamber volume and reduce pressure fluctuations. Various modifications will become possible for those skilled in the art after receiving the teachings of the present disclosure without departing from the scope thereof. It will be understood that the present invention may provide two secondary chambers defined by partitions in the lubricant chamber. The two chambers may constitute secondary inlet chambers. Alternatively, the two chambers may constitute secondary outlet chambers. As yet another alternative one chamber may constitute a secondary inlet chamber while the other chamber may constitute a secondary outlet chamber. Although the illustrated embodiments show two secondary chambers, it is also within the scope of the present invention to provide only one secondary chamber which may be either a secondary inlet chamber or a secondary outlet chamber.

What is claimed is:

1. A swash plate compressor including a cylinder formed with an axial bore, a piston slidably disposed in the bore, a swash plate supported within the cylinder for reciprocating the piston upon rotation of the swash plate, a lubricant chamber formed in a lower portion of the cylinder, a cylinder head attached to an end of the cylinder, the cylinder head being formed with an outlet chamber, and outlet valve means disposed between the bore and the outlet chamber, characterized by comprising:

partition means sealingly defining a secondary outlet chamber in an upper portion of the lubricant chamber; and a passageway communicating the secondary outlet chamber with said outlet chamber;

the cylinder head being further formed with an inlet chamber, the compressor further comprising inlet valve means disposed between the bore and the inlet chamber;

the secondary outlet chamber communicating only with said outlet chamber.

* * * * *